United States Patent [19]

Ahroni

[11] 4,274,698

[45] Jun. 23, 1981

[54] FUSED ELECTRIC PLUG WITH SNAP-FITTED BODY PARTS

[76] Inventor: Joseph M. Ahroni, 1631-16th Ave. #413, Seattle, Wash. 98119

[21] Appl. No.: 13,319

[22] Filed: Feb. 21, 1979

[51] Int. Cl.[3] ..... H01R 13/514; H01R 33/04; H01H 85/02

[52] U.S. Cl. ..... 339/147 P; 339/196 R; 339/206 P; 337/198

[58] Field of Search ..... 339/147, 75 P, 77, 78, 339/176 P, 276 R, 195, 196, 166 R, 198 J, 198 H, 206, 207, 208, 210; 337/260, 263, 201, 213, 214, 212, 233, 297, 245, 264, 196–198

[56] References Cited

U.S. PATENT DOCUMENTS

| | | | |
|---|---|---|---|
| 1,902,568 | 3/1933 | Maxam | 337/201 X |
| 3,179,915 | 4/1965 | Klassen | 339/208 X |
| 3,335,394 | 8/1967 | Miller | 339/208 X |
| 3,585,556 | 6/1971 | Hingorany | 337/297 |
| 3,716,820 | 2/1973 | Deakin | 339/176 P X |
| 3,832,676 | 8/1974 | Joly | 339/147 P |
| 3,976,967 | 8/1976 | Magherini | 337/264 X |
| 4,029,896 | 6/1977 | Skinner | 339/208 X |
| 4,033,658 | 7/1977 | Asick | 339/210 M X |
| 4,040,703 | 8/1977 | Shaffer | 339/210 R X |
| 4,067,634 | 1/1978 | Hoffman | 339/210 M X |

FOREIGN PATENT DOCUMENTS

| | | | |
|---|---|---|---|
| 2067733 | 8/1971 | France | 339/207 R |

*Primary Examiner*—John McQuade
*Assistant Examiner*—John S. Brown
*Attorney, Agent, or Firm*—Seed, Berry, Vernon & Baynham

[57] ABSTRACT

A fused electric plug has its housing made up by a pair of body shells and a slide door which can each be injection molded of a rigid thermoplastic material and yet will all snap-fit together and remain locked in position with a pair of conductor prongs held between the shells. Access to a pair of fuses in readily obtained after sliding the door to an open position whereat the door is held in operative position on the plug body.

6 Claims, 15 Drawing Figures

FIG. 5
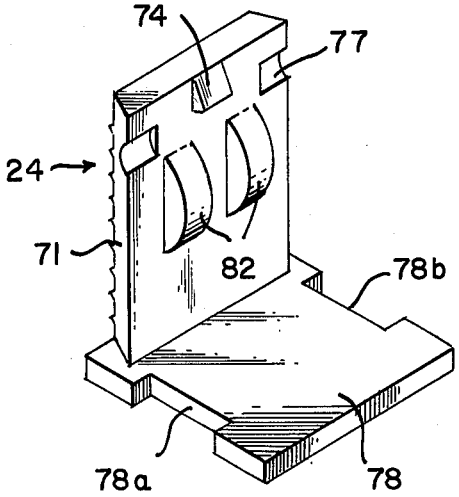
FIG. 6
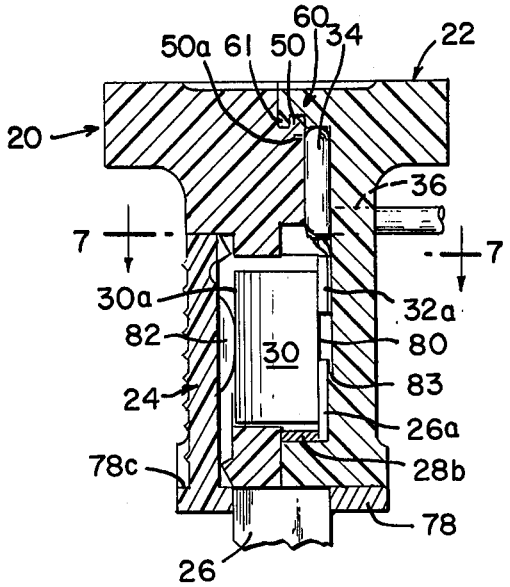
FIG. 7
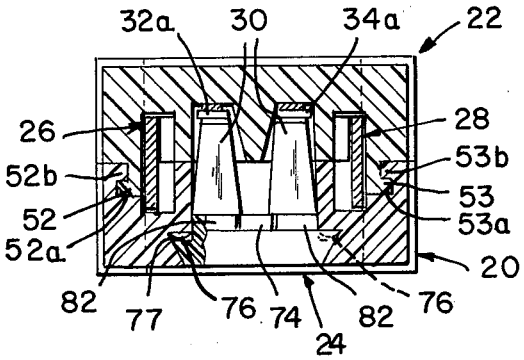
FIG. 8
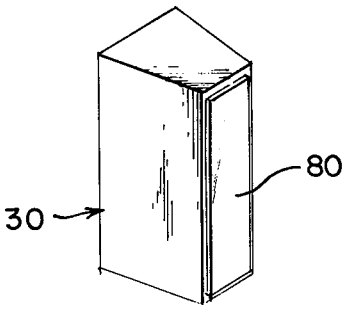
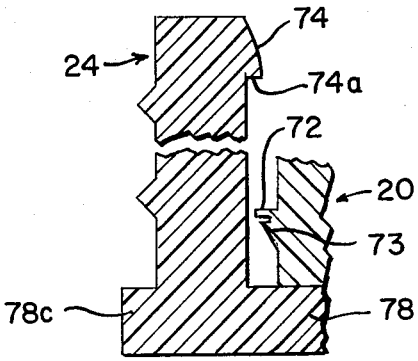
FIG. 9

FUSED ELECTRIC PLUG WITH SNAP-FITTED BODY PARTS

BACKGROUND OF THE INVENTION

1. Field of the Invention

The present invention relates to electric plugs, and more particularly to plugs which are self-fused.

2. Description of the Prior Art

For safety reasons it is desirable that electric plugs be fused sot that the circuit served by the plug will be broken at the plug just in case of a short circuit or overloaded condition rather than depending on the fuses or circuit breakers in the building. It is now recognized, for example, that Christmas tree light sets should be fused at an amperage rating lower than the rating of the normal home wiring circuit and fused plugs have been developed for this purpose.

Heretofore the assembly of fused plugs has involved the use of fastening devices such as screws or rivets, or the use of adhesive or other bonding techniques to secure the parts of the plug body together. It is desirable that there be ready access to the fuses in the plug for replacement, and that this access be accomplished by way of a door rather than necessitating that the plug body be disassembled. When a door is provided it should be maintained in closed position when the plug is in use, and it is advantageous to have the door remain connected to the plug body when in open position. It is preferred that the foregoing be accomplished without the need of components that cannot be molded as an integral part of the plug body and door.

For economy it is preferred to injection mold the plug body parts and the door, but the most favored thermoplastics for electric plug use are rigid and therefore not flexible. Accordingly, the design techniques commonly employed to interfit soft vinyl or rubber plug components, or relatively flexible plastic parts such as used in plastic boxes, cannot be used for rigid plastic components.

SUMMARY OF THE INVENTION

The present invention aims to provide an improved electric plug body whose parts can be injection molded and formed of a rigid plastic, and yet can be easily assembled without the use of auxiliary fasteners and will have its components locked together when in assembled condition.

Another object is to provide such a plug body which has its parts formed such that they can be easily manually snapped together to accomplish the assembly operation.

The invention also aims to provide an improved door arrangement and construction for a fused plug whereby the door can be readily manually inserted in place and be permanently held in assembled relation to the plug body without the need of auxiliary parts, and whereby the door cannot be opened when the plug is in use and will otherwise be held in closed position.

A further object is to provide an improved fuse unit and arrangement whereby a spare fuse link is provided.

In accomplishing the foregoing objectives the invention also aims to provide a plug assembly of minimum parts, of economical construction, which can be easily manually assembled without need of tools or the use of bonding agents or techniques, and which can be used, for example, to make add-on plugs of the type used for Christmas tree light sets.

The present invention provides two interfitting plug body shells which can be injection molded of a rigid plastic and which retain a pair of conductive prong members and a pair of wire leads in place when the shells are snap-fitted together. A pair of side-by-side fuse cavities are provided by the body shells betwen the prongs and the fuses are retained in these cavities by a slide door which interfits with one of the body shells and is held in assembled condition by a novel locking finger arrangement.

BRIEF DESCRIPTION OF THE DRAWINGS

In the accompanying drawings:

FIG. 5 is a perspective view of the slide door as seen from the underside;

FIG. 6 is a sectional view taken along the line 6—6 of FIG. 3;

FIG. 7 is a transverse sectional view taken as indicated by line 7—7 of FIG. 6;

FIG. 8 is a perspective view of one of the fuses as view from the fuse link side;

FIG. 9 is a fragmentary longitudinal sectional view to an enlarged scale through the slide door and showing the locking finger provided by the front body shell;

DETAILED DESCRIPTION OF THE PREFERRED EMBODIMENTS

Figure 1:
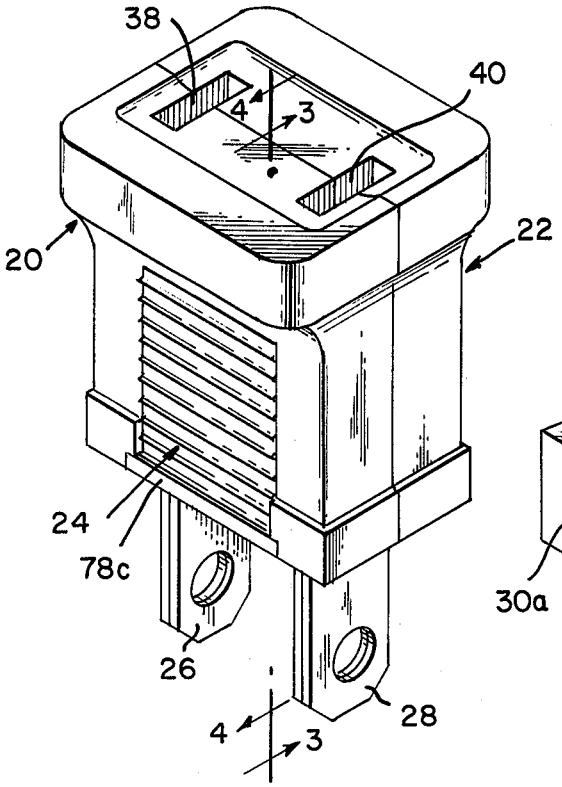
FIG. 1 is a perspective view of an assembled plug embodying the present invention.
Figure 2:
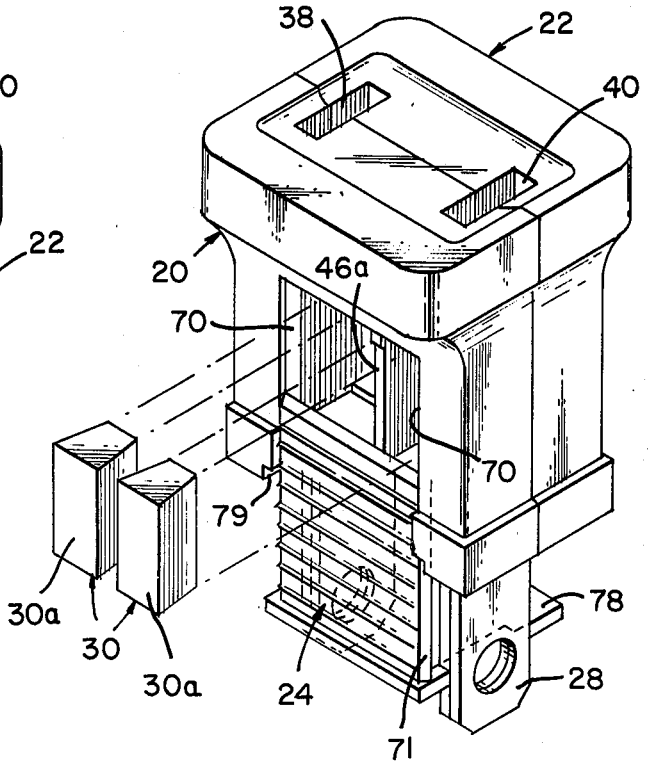
FIG. 2 is a perspective view of the plug with the door opened and the fuses shown removed.

Referring to the drawings, it is seen that the plug assembly of the present invention comprises a front body shell 20, a rear body shell 22, a slide cover 24, left and right prong members 26 and 28, and a pair of fuses 30. Insulated wire leads 32, 34 enter the plug body through an opening 36 in the back of the rear shell 22. When the unit is assembled, the shells 20, 22 collectively provide a pair of sockets 38, 40 for the prongs of an add-on plug. Directing attention to FIGS. 3 and 4, it is seen that the sockets 38, 40 are formed by elongated recesses 38R, 40R in the rear shell 22 and opposed elongated recesses 38F, 40F in the front shell 20. These recesses also serve to hold the prong members 26, 28.

Figure 3:
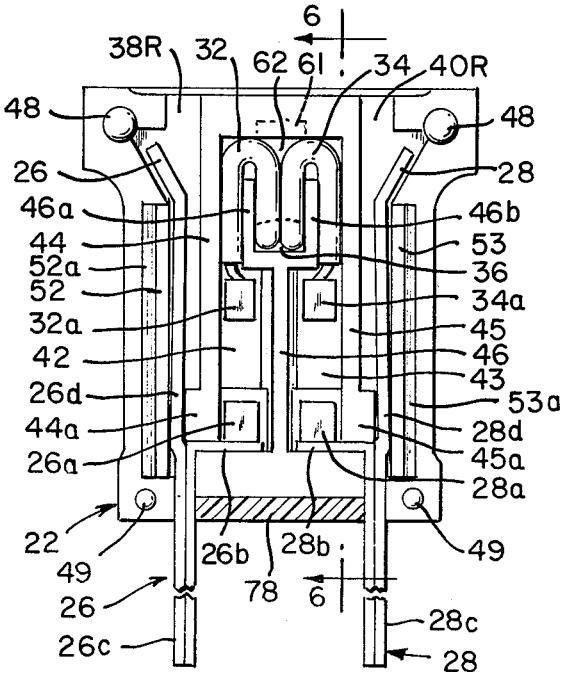
FIGS. 3 and 4 are longitudinal sectional views taken as indicated by lines 3—3 and 4—4, respectively, in FIG. 1.
Figure 4:
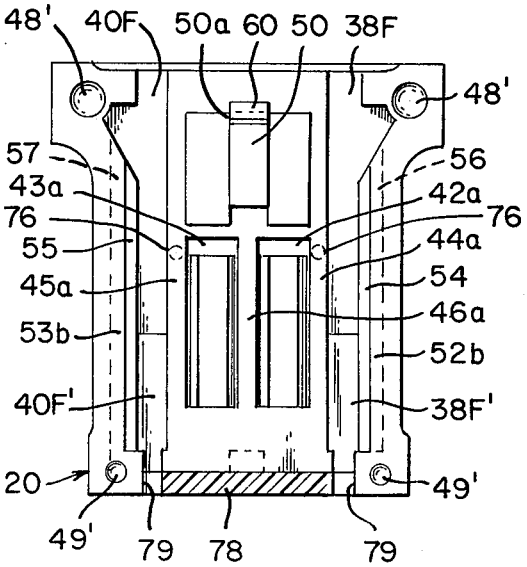

The rear shell 22 is formed with a pair of fuse cavities 42, 43 separated by longitudinal walls 44, 45 from the recesses 38R, 40R and separated in the center from one another by a forked wall 46 whose forks **46*a*, 46*b* define inverted U-shaped lead wire passages from the rear opening 36 to the upper end of the fuse cavities. As shown in FIG. 3, the lead wires, after entering through the rear opening 36 pass upwardly side by side between the forks 46***a*, 46*b* and then double back between the forks and the walls 44, 45 to extend by skinned terminal ends into the upper end of the fuse cavities. These skinned terminal ends may be provided with upper terminals 32*a*, 34*a* crimped to the wire. These upper terminals are opposed by lower terminals 26*a*, 28*a* presented as right angle tabs from the lower side edges of opposed coplanar prong portions 26*b*, 28*b* which extend through narrow slots connecting the lower end of the recesses 38R, 40R with the bottom of the fuse cavities 42, 43. From the portions 26*b*, *28b* the prongs 26, 28 have right angle bends to doubled outwardly projecting prongs proper from which leg portions 26*c*, 28*c* continue upwardly along the outer sides of the recesses 38R, 40R to outwardly flared end portions 26*d*, 28*d*. The divider walls 44, 45 are preferably stepped at their lower ends as indicated at 44*a*, 45*a*.

The rear shell 22 is provided with pairs of upper and lower corner dowels 48, 49 which register with holes 48', 49' in the front shell 20. Directing attention to FIG. 4, the front shell 20 is formed with a pair of central rectangular fuse ports 42*a*, 43*a* which overlie the fuse cavities 42, 43 and are separated by a center wall 46*a* which abuts the wall 46. The fuse ports 42*a*, 43*a* are separated from the longitudinal recesses 38F, 40F by walls 44*a*, 45*a* which abut the walls 44, 45 of the rear shell. It will be noted that the floor of the recesses 38F, 40F have shallow stepped portions 38F', 40F' resting against upper edges of the prong legs 26*c*, 28*c* to hold the prongs 26, 28 firmly between the shells 20, 22 at the lower portion thereof and provide adequate tolerance in the sockets 38, 40 for easy insertion of the prongs of an add-on plug. The front shell 20 is formed with a rearwardly projecting lug 50 arranged to bear against the wire leads 32, 34 between the forks 46*a*, 46*b*. For weight saving the front shell may be recessed on both sides of the lug 50.

Figure 11:
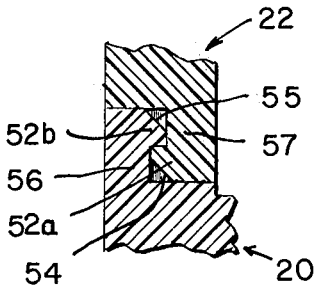
FIG. 11 is a detail fragmentary transverse sectional view of the locking interfit at the left side of FIG. 7.

As a significant part of the present invention there is provided a pair of longitudinal locking lands 52, 53 adjoining the outer edges of the recesses 38R, 40R. These lands are generally L-shaped in transverse cross-section providing an enlarged locking head with an outwardly extending flange 52*a*, 53*a* which can be deflected toward the center of the shell by inward bending of the lands toward one another. The longitudinal recesses 38F, 40F are widened along their outer sides at respective steps 54, 55 and their outer side faces along these steps are longitudinally grooved to provide locking flanges 56, 57 behind which the land flanges 52*a*, 53*a* are lodged. As shown in FIG. 11, the top face of the flanges 52*a*, 53*a* and the top face of the flanges 56, 57 are preferably tapered or rounded to provide cooperating wedge faces 54 and 55, respectively, which function to deflect the locking lands 52, 53 sufficiently when the shells 20, 22 are pressed together with the dowels 48 registering with the holes 48', to permit the nose of the land flanges 52*a*, 53*a* to clear the nose of the locking flanges 56, 57 and the land flanges to then snap into locking position behind the locking flanges.

Locking of the shells 20, 22 together may be assisted by additional locking means at the top and/or bottom of the shells. For example, directing attention to FIGS. 4 and 6 it is seen that the lug 50 has a transverse slot 50*a* near its upper end to provide a locking tab 60. This tab has a cross-section shaped like that of the locking lands 52, 53 and it interfits with a locking flange 61 shaped in cross-section like the locking flanges 56, 57. The locking flange 61 is formed by grooving the upper wall of the cavity 62 in the rear shell 22 located above the wall forks 46*a*, 46*b*.

Figure 10:
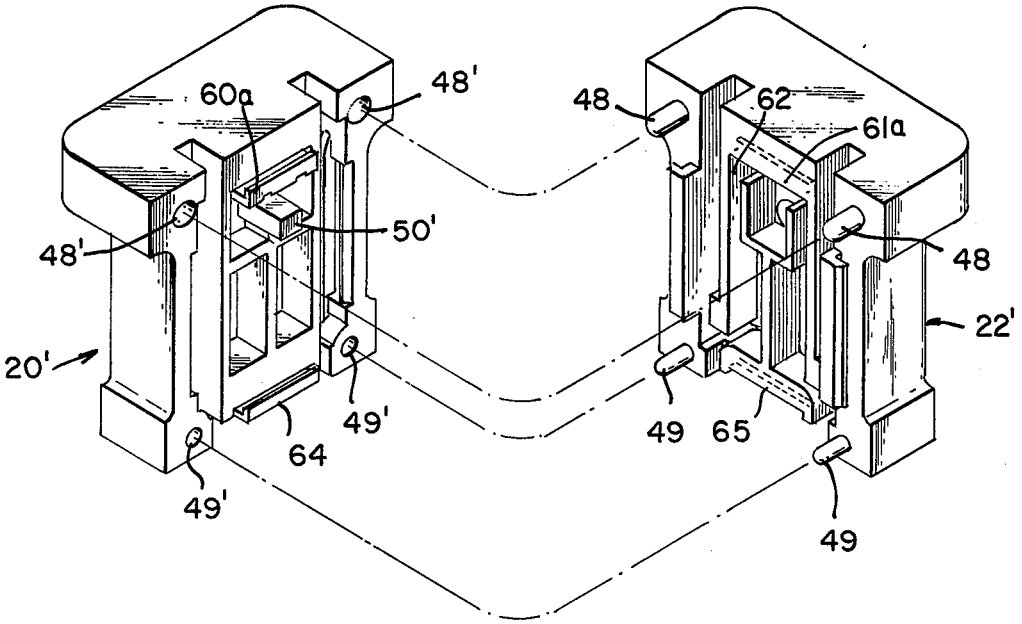
FIG. 10 is a perspective exploded view of the body shells of a modified plug body.
Figure 12:
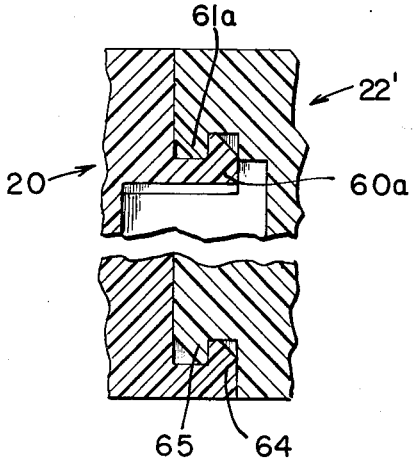
FIG. 12 is a fragmentary longitudinal sectional view of the modified plug shown in FIG. 10 and taken in the same manner as FIG. 6.

As shown in FIGS. 10 and 12, as an alternative to the locking tab 60, a longer transverse tab 60*a* may be provided which interfits with a locking flange 61*a* formed across substantially the entire upper wall of the cavity 62 in the rear shell 22'. A lug 50' of reduced size is provided in place of lug 50. At the bottom of the shells 20',22' a second elongated transverse locking tab 64 is provided like the tab 60*a*, and this second tab interfits with a locking flange 65 formed like the flange 61 and located in the bottom wall of the rear shell 22'.

As previously indicated, the front shell 20 has fuse access openings 42*a*, 43*a* covered by a slide door 24. At the front of shell 20 there is provided a pair of beveled slide tracks 70 whose bevel is matched by beveled side edges 71 on the door 24 whereby the door is held in position. The front face of the center wall 46*a* is at a lower level than the tracks 70, and as best shown in FIG. 9, is formed with a forwardly projecting locking finger 72 which is separated by a narrow gap from a beveled stop 73 which is of less height than the locking finger. Complementing the locking finger 72 is a locking lug 74 on the underside of the door at the upper end thereof which slopes to a downwardly facing stop shoulder 74*a*. This stop shoulder has a depth shallow enough to barely clear the stop 73, but is arranged to engage the finger 72. Thus, the door 24 can initially be inserted in the tracks 70 from the lower open end and pushed upwardly until the lug 74 engages the finger 72, and then pushed further with enough manual pressure to bend the finger sufficiently for the lug 74 to pass by the bent finger. The finger 72 then springs back. When the door is later moved to its open position, the stop face 74*a* engages the finger 72 and starts to bend it toward the open end of the door tracks. However, as soon as the finger 72 closes the narrow gap between it and the stop 73, the stop 73 prevents substantially all further movement of the finger and in this manner the door 24 is retained in interfiting relation with the tracks 70.

It will be appreciated that in FIG. 9 the width of the gap between the finger 72 and the stop 73 is purposely exaggerated because of the relatively small scale of the drawing.

When the door 24 is in fully closed position, it is retained by shallow latching knobs 76 (FIG. 7) near the upper end of the tracks 70 which interfit with detents 77 on the underside of the door. There is sufficient tolerance to permit the upper end of the door to ride over the knobs 76. The front face of the door may be serrated as shown in FIG. 1 and provided with a bottom front lip 78*c* to assist in obtaining a thumb hold to open the door. At its lower end the door 24 is preferably also formed with a rearwardly extending flange 78 which abuts the bottom of the plug body when the door is closed. To give a flush bottom side to the plug body when the door 24 is in closed position, the bottom of the shells 20, 22 are recessed between the prongs 26, 28 as indicated at 79 in FIG. 1. It is preferred to have the door flange 78 interfit with the prongs 26, 28 while the door is being slid into open position, and hence the side edges of the flange 78 are recessed at 78*a*, 78*b*.

As shown in FIG. 8, the fuses 30 have a non-conductive plastic body of prismatoid shape which may be tapered for ease of installation and so that in can only be inserted in the proper position. The narrower base face is covered with a fuse link 80 taking the form of a thin strip of suitable conductive material having a cross-sectional area selected for the desired amperage limit. The fuse link 80 is bonded to the fuse body with a suitable adhesive. To keep the end portions of the fuse link 80 of the two fuses in conductive engagement with respective of the terminals 26*a*, 32*a* and 28*a*, *34a* there is provided a pair of rounded retainers 82 on the underside of the door 24 which, as shown in FIG. 6, have a depth sufficient to firmly engage the front face 30*a* of the fuse bodies. Since the terminals 32*a*, 34*a* and the wire portions to which they are connected will normally collectively be thicker than the terminals 26*a*, 28*a* it is preferred to step the lower end portion of the back wall of the fuse receiving recesses 42, 43 a corresponding amount as indicated in FIG. 6. at 83.

Figure 13:
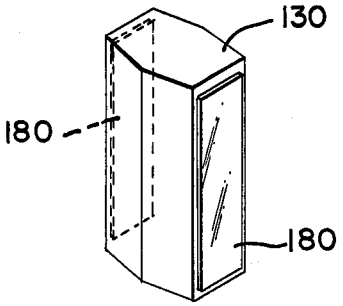
FIG. 13 is a perspective view of a modified fuse.

Directing attention to FIG. 13, when a spare fuse is desired a modified fuse body 130 may be provided having a pair of fuse links 180 bonded thereto on its opposite faces. With this arrangement the fuse can be reversed if one of the links 180 has been violated and is no longer operative.

Figure 14:
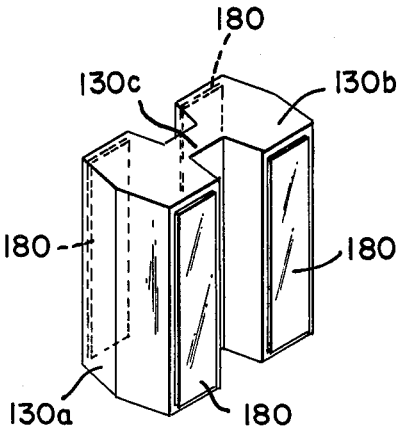
FIG. 14 is a perspective view of still a further modified fuse.
Figure 15:
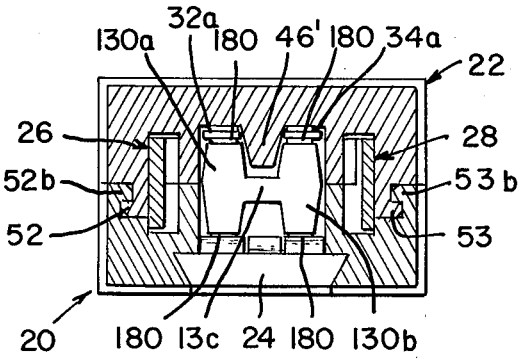
FIG. 15 is a transverse sectional view of a modified plug for the fuse of FIG. 14.

As indicated in FIGS. 14 and 15, rather than handling two fuses, a pair 130*a*, 130*b* can be provided which are connected in the middle by a bridge 130*c*. In this instance, as shown in FIG. 15, the center wall 46*a* in the front shell 20 is eliminated and the center wall 46 in the rear shell 22 is made shallower as indicated at 46'. In the practice of the present invention it is preferred to use a tough rigid thermoplastic material for the plug shells 20, 22 and door 24 which is self-extinguishing, has good gloss and surface hardness, good chemical resistance to acids and alkalis, and good heat stability and flame resistance. A suitable such material is an unplasticized (rigid) homopolymer compound such as "Ethyl 7042" manufactured by the Polymer Division of the Ethyl Corporation, Baton Rouge, Louisiana. The present invention makes it possible to use such a rigid material and still snap-fit the plug body parts in the manner described. Hence, assembly of the plug unit is easily accomplished. First the wire leads 32, 34 with contact terminals 32a, 34a applied are threaded through the rear opening 36 into the cavity 62, laid in the wireways formed by the wall forks 46*a*, 46*b*, and pulled tight from the rear so that the terminals 32*a*, 34*a* are properly located at the top of the recesses 42, 43. Then the prong members 26, 28 are set in position in the rear shell 22. Next, the front shell 20 is brought into position with it dowel holes 48, 49 registering with the pairs of dowels 48, 49 to thereby properly align the shells and their related locking components. It is then only necessary to manually press the shells 20, 22 together and a snap-fit is achieved whereupon the shells are locked together. Finally, the door 24 is slid into operating position on the front shell, the fuses 30 are dropped into place through the access openings 42, 43 and the door is closed.

Although the invention has been described as applied to an add-on plug for use on Christmas tree light sets, it is not limited to that use. It will be apparent that the invention is readily applicable to other types of electric plugs, and that certain parts of the invention have still wider applicability.

I claim:

1. A fused plug comprising:

a plug body formed by front and rear mating shells, said body having top and bottom end faces interconnected by side faces and front and rear faces, said rear shell being formed with a fuse recess area having a closed back wall, said front shell having a front access to said fuse recess area, a pair of electrical conductor means in said body having respective exposed terminal portions at the upper end portion of said fuse recess area, a pair of conductor prong members projecting through the bottom end of said body for insertion into a socket and presenting respective exposed contact members at the bottom end portion of said fuse recess area, fuse means providing a pair of fuses in said fuse recess area, each fuse having a fuse body and respective elongated fuse links of thin, electrically conductive strip material secured flat against the fuse body and arranged to engage and connect respective of said terminal portions to respective of the prong contact members, said fuse means being adapted to pass through said front access, door means on said front shell for covering said front access when in a closed position and for giving access to said fuses when in an open position, said door means having a sliding interfit with said plug body and having inwardly projecting means engaging the top of the fuse means when the door means is in closed position, and interfitting means at the back of said front shell and at the front of said rear shell integral with the shells whereby said shells can be fitted together for assembly.

2. A fused plug according to claim 1 in which said door means is movable between said positions independently of said fuses.

3. A fused plug according to claim 1 in which said rear shell has a rear opening and is formed with wireway means from said rear opening to the top of said fuse recess area, said electrical conductor means comprising a pair of wire leads in said wireway means and passing through said rear opening.

4. A fused plug according to claim 1 in which said pair of fuses have the same body.

5. A fused plug according to claim 1 in which said interfitting means comprises corner dowels extending integrally from one of the body shells into the other body shell.

6. A fused plug according to claim 1 in which each fuse has a spare fuse link arranged to engage and connect respective of said terminal portions to respective of the prong contact members when the fuse is removed, turned over, and then reinserted.

* * * * *